US006240581B1

(12) United States Patent
Pender

(10) Patent No.: US 6,240,581 B1
(45) Date of Patent: Jun. 5, 2001

(54) SHEET AND BLANKET SUPPORT

(76) Inventor: Tom N. Pender, P.O. Box 5728, Vancouver, WA (US) 98668-5728

( * ) Notice: Subject to any disclaimer, the term of this patent is extended or adjusted under 35 U.S.C. 154(b) by 0 days.

(21) Appl. No.: 09/604,241

(22) Filed: Jun. 27, 2000

(51) Int. Cl.[7] ..... A47C 21/02
(52) U.S. Cl. ..... 5/505.1
(58) Field of Search ..... 5/505.1, 504.1, 5/503.1, 506.1, 691

(56) References Cited

U.S. PATENT DOCUMENTS

| | | | | |
|---|---|---|---|---|
| 1,175,526 | | 3/1916 | Jones | 5/505.1 |
| 2,106,834 | | 2/1938 | Ewald | 5/505.1 |
| 2,235,191 | * | 3/1941 | Arnold | 5/505.1 |
| 2,356,219 | * | 8/1944 | Coffing | 5/505.1 |
| 2,598,295 | | 5/1952 | Pelton | 5/505.1 |
| 2,618,789 | | 11/1952 | Kane | 5/505.1 |
| 2,642,589 | | 6/1953 | Cobb | 5/505.1 |
| 4,214,327 | | 7/1980 | Smith | 5/504.1 |
| 5,175,899 | * | 1/1993 | Lou | 5/505.1 |

* cited by examiner

*Primary Examiner*—Alexander Grosz
(74) *Attorney, Agent, or Firm*—James D. Givnan, Jr.

(57) ABSTRACT

A support structure serves to elevate bedding from the feet of a patient or sleeper. A base of the support is of U-shape as is a positionable member of the support. Pairs of brackets pivotally support the positionable member which includes a lock for retention in the upright position. A retainer sheet on the base of the support is for insertion beneath a mattress to prevent shifting of the base member. Attachment of the retainer sheet to the base is in a removable manner to permit convenient separation and removal of the support from a bed.

7 Claims, 1 Drawing Sheet

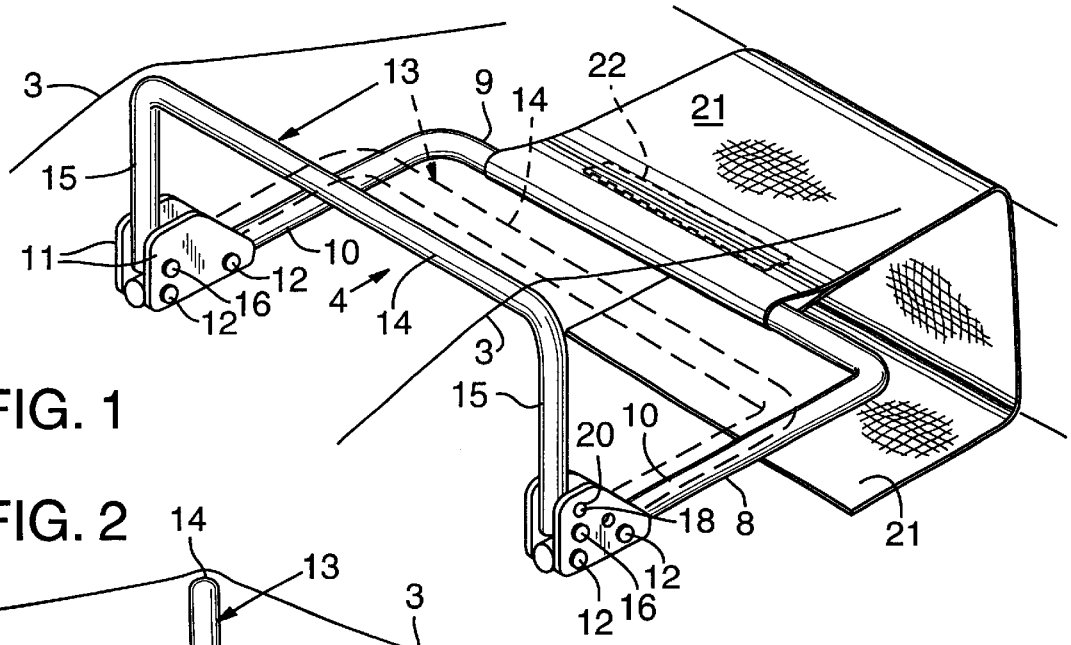
FIG. 1
FIG. 2
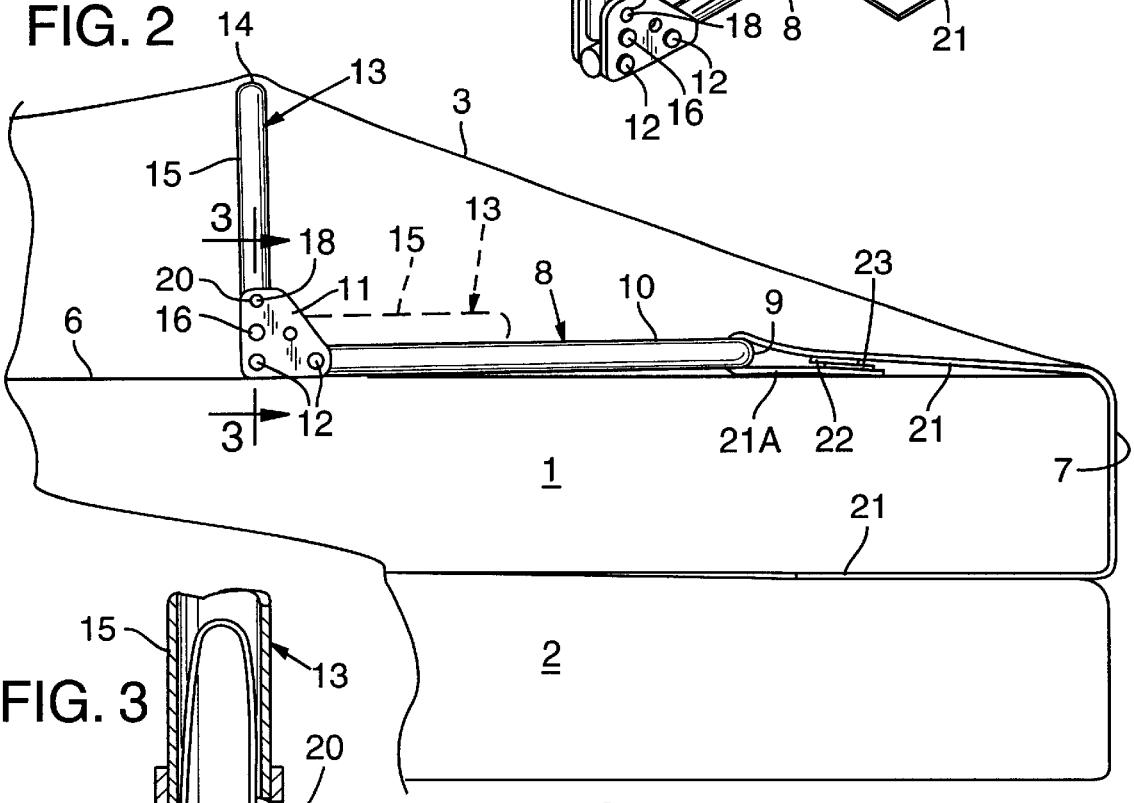
FIG. 3
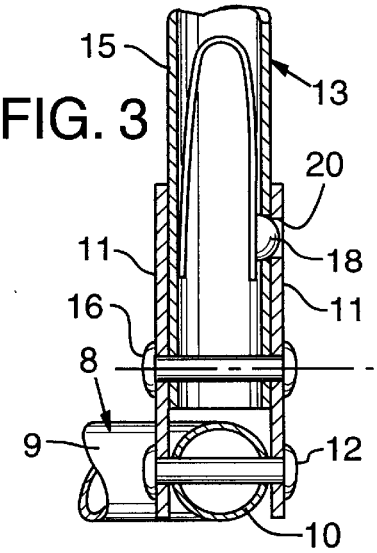
FIG. 4
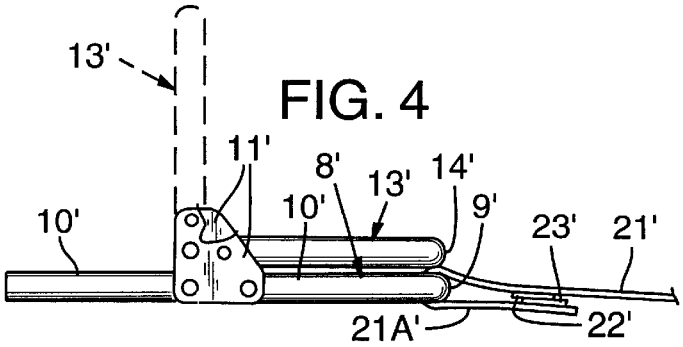

SHEET AND BLANKET SUPPORT

BACKGROUND OF THE INVENTION

The present invention pertains generally to a support for elevating bedding away from the feet of a bed occupant.

Not uncommonly the weight of bedding on a person's feet, ankles and lower legs can be bothersome to hinder a sound sleep is. Additionally, people confined to bed on their back over long periods find it uncomfortable to support the weight of a sheet and blanket with the feet. This problem is particularly troublesome to patients with foot ailments. People who have become accustomed to sleeping with the bedding elevated from their feet oftimes find it difficult to sleep, when away from home, without having access to a bedding support. Some of their problems have been recognized in the prior art as discussed below.

U.S. Pat. No. 4,214,327 discloses a bedding support having rigid upper and lower components joined by a hinge with the support not lending itself to convenient removal or transport.

U.S. Pat. No. 2,642,589 discloses a U-shaped base for insertion beneath a mattress with a second member swingably mounted on pivots located adjacent the end of a mattress. The swingable member is positionable between vertical and horizontal positions while the base member is confined by the mattress.

U.S. Pat. No. 2,618,789 discloses a framework having a lower portion for insertion beneath a mattress while an upper portion is pivotally mounted for positioning to the vertical and the horizontal with tubular locks being slidable over hinged components to lock the positionable member in an upright position.

U.S. Pat. No. 2,598,295 discloses a bedding support having an insertable member more or less permanently confined beneath a mattress by a tether with an adjustable upper frame including a pivot to adjust support height with actuating means embodied in a worm drive to raise and lower the upper portion. This unit is clearly not intended to be portable.

U.S. Pat. No. 2,106,834 discloses a bedding support for placement at the end or sides of a mattress with a base member having upturned end segments in which is swingably mounted a U-shaped bedding support member positionable about horizontal and vertical axes.

U.S. Pat. No. 1,175,526 discloses a bedding support having a base member insertable beneath a mattress with a positionable member hingedly carried along an exposed side of the base member permitting vertical adjustment of a bedding support member.

SUMMARY OF THE PRESENT INVENTION

The present invention is embodied in a support for bedding which is confined in place by a retainer of pliable material.

The retainer extends from a base of the support for inverted placement beneath a mattress. Fabric closure members permit separation of the retainer sheet from the remainder of the support. A U-shaped positionable member may be collapsed to overlie, at least partially, the base to permit convenient transport in luggage with minimum loss of storage space.

Important objectives of the present invention include the provision of a bedding support with a pliable sheet with closure means extending about a base of the support permitting convenient installation and removal of the support; the provision of a bedding support having a base member and an overlying positionable member which, when in a collapsed state, provides a structure readily stowed within a piece of luggage to permit a traveler to use of the support when away from home; the position of a bedding support utilizing a pliable retainer of sheet material readily engageable with a base member of the support to permit removal and installation without disturbing or requiring the removal of bedding and which may be left in place until the user wishes to reinstall the bedding support; the provision of a bedding support having a low profile which does not detract from the appearance of a made bed; the provision of a lightweight bedding support which lends itself to transport within a piece of luggage without significantly reducing the space therein.

BRIEF DESCRIPTION OF THE DRAWINGS

In the accompanying drawings:

FIG. 1 is a perspective view showing the present bedding support operatively in place with a positionable member also shown collapsed in broken lines;

FIG. 2 is a side elevational view of the present support operatively disposed on a mattress end box spring;

FIG. 3 is a vertical sectional view taken along 3—3 of FIG. 2; and

FIG. 4 is a side elevational view of a modified bedding support with the positionable member also shown elevated in a broken line position.

DETAILED DESCRIPTION OF THE PREFERRED EMBODIMENTS

With continuing attention to the drawing wherein applied reference numerals indicate parts similarly hereinafter identified, the reference numeral 1 indicates the mattress in place on a supporting surface, such a box spring 2. Bedding at 3 is shown in a schematic manner and may include a sheet and one or more blankets, utilized in the usual manner.

The present bedding support indicated generally at 4 is shown operatively disposed on a mattress covering such as a lower sheet at 6. Reference numeral 7 indicates the lower end of the mattress.

The bedding support includes a base at 8 shown as being of light weight tubular construction of U-shape and having a cross member at 9 joining parallel segments 10. Pairs of gussets at 11 receive the distal ends of tubular members 10 which are secured therein as by fasteners 12 shown as rivets.

A positionable member 13 of the bedding support, as shown, includes a U-shaped cross member at 14 and parallel segments at 15 having distal ends pivotally carried by pivot pins 16 extending through a pair of gussets 11. Accordingly, positionable member 13 may be vertically disposed as shown in FIG. 1 or collapsed when not in use as shown in the broken line position of FIG. 1. A distal end segment of a parallel segment 15 includes a spring biased lock at 18 which may seat in an opening 20 in one of the gussets 11. The lock prevents downward displacement of positionable member 13 under all but intentional collapsing of the member in place on base 8 in an inoperable position.

A pliable retainer sheet of material at 21 serves to retain base 8 in place during use. The retainer sheet 21 is of an expanse to cover a significant portion of cross member 9 and of a length to extend toward end 7 of the mattress, about the end and back under the mattress several inches between the mattress and mattress supporting member 2, for example, a box spring. The preferred form of attaching retainer 21 to base cross member 9 is by cooperating hook and loop fabric closure strips at 22 and 23, suitably secured to sheet 21 and a reversed segment 21A of the retainer. Alternative, attachment means may include cooperating snap components in place on the retainer sheet.

In FIG. 4 a modified form of the present bedding support is shown to include components identified with prime reference numerals which indicate parts corresponding to those earlier identified with base reference numerals. In the modified form, pairs of gussets at 11' are relocated on a base 8' toward a cross member 9' of the base. A positionable member 13' is accordingly positioned so as to locate cross member 14', when collapsed, in place on cross member 9' of the base member. Such relocating of the positionable member provides a clear, unobstructed area between the parallel members 10' and parallel member 15' to contribute to the occupying of less space in a piece of luggage and hence contributing to the portability of the present support.

In use, the bedding support may be removed or detached from its retainer sheet 21 to render the bed of customary appearance which removal is facilitated by the use of fabric closures or other attachment means.

While I have shown but a few embodiments of the invention, it will be apparent to those skilled in the art that the invention may be embodied still otherwise without departing from the spirit and scope of the claimed invention

Having thus described the invention, what is desired to be secured by a Letters Patent is:

1. A bedding support, comprising, a base adapted to be removably placed on a top surface of a component of a bed, such as a mattress, a pliable sheet member for partial insertion below a component of a bed, attachment means for joining the sheet member to said base to restrain the latter, a positionable member having raised and collapsed positions said positionable member adapted to support bedding such as a blanket or sheet, and pivot means for coupling the base and said positionable member.

2. The bedding support claimed in claim 1 wherein said attachment means include fabric closure members.

3. The bedding support claimed in claim 2 wherein said fabric closure members are of the hook and loop type.

4. The bedding support claimed in claim 1 wherein said attachment means includes a portion of said pliable member in wrapped engagement with the base.

5. The bedding support claimed in claim 1 wherein said positionable member is supported by said base when said positionable member is in a collapsed position.

6. The bedding support claimed in claim 1 wherein said positionable member rests on said base when in a collapsed position.

7. The bedding support claimed in claim 1 additionally including a lock operable to maintain the positionable member against movement about said pivot means.

* * * * *